US006831396B2

(12) United States Patent
Nishikawa

(10) Patent No.: US 6,831,396 B2
(45) Date of Patent: Dec. 14, 2004

(54) SPARK PLUG WITH GLAZE AND MARKING

(75) Inventor: Kenichi Nishikawa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 61 days.

(21) Appl. No.: 09/892,788

(22) Filed: Jun. 28, 2001

(65) Prior Publication Data

US 2002/0041136 A1 Apr. 11, 2002

(30) Foreign Application Priority Data

Jun. 28, 2000 (JP) ..... 2000-194617

(51) Int. Cl.[7] ..... H01T 13/00

(52) U.S. Cl. ..... 313/118; 313/123; 313/130; 313/137; 313/141; 313/143; 445/7; 106/286.4; 106/286.6; 428/522; 428/336; 501/14

(58) Field of Search ..... 106/286.4, 286.6; 428/522, 336, 689, 697, 699, 701, 702; 313/118, 123, 130, 137, 141, 143; 123/169 EL, 169 PB; 445/7; 501/14

(56) References Cited

U.S. PATENT DOCUMENTS

| | | | | |
|---|---|---|---|---|
| 4,084,976 A | | 4/1978 | Hinton | |
| 4,120,733 A | | 10/1978 | Knapp | |
| 4,256,497 A | | 3/1981 | Knapp | |
| 5,080,718 A | * | 1/1992 | Sullivan et al. | 106/401 |
| 5,273,575 A | * | 12/1993 | de Saint Romain | 106/31.05 |
| 5,518,968 A | | 5/1996 | Knapp | 501/14 |
| 5,677,250 A | | 10/1997 | Knapp | |
| 5,753,026 A | * | 5/1998 | Kuntz et al. | 106/401 |
| 5,859,491 A | | 1/1999 | Nishikawa et al. | |
| 6,110,566 A | * | 8/2000 | White et al. | 428/172 |
| 6,114,054 A | * | 9/2000 | Klein et al. | 427/376.2 |
| 6,287,163 B2 | * | 9/2001 | Tanaka et al. | 427/376.2 |
| 6,524,703 B1 | * | 2/2003 | Court | 428/402 |

FOREIGN PATENT DOCUMENTS

| | | |
|---|---|---|
| EP | 0 802 071 A1 | 10/1997 |
| EP | 0 959 542 A1 | 11/1999 |
| JP | 51-127910 | 10/1979 |
| JP | 10-236845 | 9/1998 |
| JP | 11-106231 | 1/1999 |
| JP | 11-43351 | 2/1999 |
| JP | 11-106234 | 4/1999 |

* cited by examiner

*Primary Examiner*—Nimeshkumar D. Patel
*Assistant Examiner*—Sikha Roy
(74) *Attorney, Agent, or Firm*—Morgan, Lewis & Bockius LLP

(57) ABSTRACT

The present application is to provide a spark plug where a marking layer 2*m* under a glaze layer 2*d* can form a color stably, even if the Pb amount is decreased in the glaze layer. The glaze layer 2*d* is formed on an insulator 2 of the spark plug, and the marking layer 2*m* is formed under the glaze layer 2*d*. The glaze layer 2*d* contains, e.g., 1 to 25 mol % of a Zn component in terms of Zno and 5 mol % or lower, e.g., 1 mol % or lower of a Pb component in terms of PbO. On the other hand, the marking layer 2*m* is adjusted in kinds and amounts of metallic element components in such manners that a tint seen through the glaze layer 2*d* is 3 or lower in brightness specified by JIS:Z8721 as well as 3 or lower in chroma specified by JIS:Z8721, or 4 or lower in the brightness specified by JIS:Z8721 as well as 2 or lower in the chroma specified by JIS:Z8721.

23 Claims, 6 Drawing Sheets

SPARK PLUG WITH GLAZE AND MARKING

BACKGROUND OF THE INVENTION

1. Field of the Invention

This invention relates to a spark plug.

2. Description of the Related Art

A spark plug used for ignition of an internal engine of such as automobiles generally comprises a metal shell to which a ground electrode is fixed, an insulator made of alumina ceramics, and a center electrode which is disposed inside the insulator. The insulator projects from the rear opening of the metal shell in the axial direction. A terminal metal fixture is inserted into the projecting part of the insulator and is connected to the center electrode via a conductive glass seal layer which is formed by a glass sealing procedure or a resistor. A high voltage is applied to the terminal metal fixture to cause a spark over the gap between the ground electrode and the center electrode.

Under some combined conditions, for example, at an increased spark plug temperature and an increased environmental humidity, it may happen that high voltage application fails to cause a spark over the gap but, instead, a discharge called as a flashover occurs between the terminal metal fixture and the metal shell, going around the projecting insulator. Primarily for the purpose of avoiding flashover, most of commonly used spark plugs have a glaze layer on the surface of the insulator. The glaze layer also serves to smoothen the insulator surface thereby preventing contamination and to enhance the chemical or mechanical strength of the insulator.

In the case of the alumina insulator for the spark plug, such a glaze of lead silicate glass has conventionally been used where silicate glass is mixed with a relatively large amount of PbO to lower a softening point. In recent years, however, with a globally increasing concern about environmental conservation, glazes containing Pb have been losing acceptance. In the automobile industry, for instance, where spark plugs find a huge demand, it has been a subject of study to phase out Pb glazes in a future, taking into consideration the adverse influences of waste spark plugs on the environment. As a substitute for the conventional Pb glazes, for example, boro-silicate glass or alkali borosilicate glass based glazes have been proposed in JP-A-11-43351 or JP-A-11-106234.

On the surface of the insulator of the spark plug, there are formed markings composed of letters, signs or other images such as manufacturer names, log marks or products numbers. The markings are printed with an ink mixed with a pigment on the insulator surface on which a glaze layer is not formed, followed by coating a glaze on the markings and baking it. In this case, the marking layer is seen through the glaze layer that is made transparent. For distinguishing kinds or forms of the spark plugs easily, the marking layer is often formed by changing a color per each of the kinds or forms.

When the marking layer is formed under the glaze layer, a coloring metallic oxide composing a pigment in the marking layer inevitably causes reaction to a certain degree with components in the glaze layer while baking the glaze. If an existing Pb containing type is employed as the glaze layer, a tint inherent in the coloring metallic oxide is easily maintained, and desired colors can be constantly obtained. However, according to an inventor's studies, it has been found that if using a glaze where the amount of Pb component in the glaze was controlled to be small like a leadless glaze, it was difficult to adjust the color in the marking layer to be desired tints.

SUMMARY OF THE INVENTION

Accordingly it is an object of the invention to offer a spark plug enabling to stably color the marking layer, which is formed under the glaze layer, even if the Pb amount is decreased in the glaze layer.

For accomplishing the above object, a first structure of the spark plug of the invention has marking layer formed on a surface of an insulator and a glaze layer covering the marking layer so that the marking layer can be seen through the glaze layer, and is characterized in that the glaze layer contains 5 mol % or less Pb component in terms of PbO, and kinds and amounts of metallic element components contained in the marking layer are adjusted in such manners that tint of the marking layer seen through the glaze layer is 3 or less in the brightness specified by JIS:Z872 , and 3 or less in the chroma specified by JIS:Z872, otherwise 4 or less in the brightness as well as 2 or less in the chroma.

Desiring the marking layer in particular to color in black, it is important that when observing the marking layer through a reflected white light, the marking layer evenly absorbs the light in each wavelength range of visible spectra such that no outstanding reflection arises by lights of specified wavelength areas, and the level of the whole reflected light is lowered. However, if the Pb amount in the black glaze layer is 5 mol % or lower in terms of PbO, other components than Pb in the glaze layer react with metallic oxides in the marking layer, and the level of light absorption of the specific wavelength by the metallic oxide generating said reaction is changed, otherwise the wavelength of the light absorption is shifted, whereby a balance of the light absorption for coloring the black is lost, and as a result, the marking layer deviates from the black and are easy to color an unwelcome tint. Under such conditions, when distinguishing kinds or types of the sparkplugs by, e.g., colors of markings, the distinguishing will be often difficult. As another realistic problem, there is a case that tint changing in the marking layer is seen to purchasers as "unreasonable alternation in familiar colors in external appearance", so that an inconvenience occurs that products could not always be quickly accepted because of a resistant feeling thereto.

Therefore, in the invention, if kinds and amounts of metallic element components contained in the marking layer are adjusted in such manners that the tint of the marking layer seen through the glaze layer of the Pb amount being 5 mol % or smaller is 3 or less in the brightness specified by JIS:Z8721 (1993) and 3 or less in the chroma, otherwise 4 or less in the brightness as well as 2 or less in the chroma, and even if the glaze layer of the low Pb amount is as mentioned above, externally appearing colors of the marking layer formed under the glaze layer can be constantly recognized as the black.

In the present specification, a measuring method of measuring the brightness and the chroma adopts the method specified in "4.3 A Measuring Method of Reflected Objects" of "4. Spectral Colorimetry" in the "A Measuring Method of Colors" of JIS-Z8722 (1994). The brightness and the chroma can be known comparing the result of measuring the brightness and the chroma by the above method with those of standard color chart prepared according to JIS-Z8721.

As a simple method, the brightness and the chroma can be known through visual comparisons with standard color chart prepared according to JIS-Z8721.

The adjustment of the kind or the amount of the metallic element components contained an the marking layer may be performed in accordance with, for example, the following technical concept. What contributes to coloring in the marking layer is mainly several kinds of transition metallic cations (called as "coloring metallic component" hereafter) ready for causing light absorption by electron transition, and it is assumed that a final coloring of the marking layer is roughly reflected spectra observed as overlapping of light absorption derived from each of metallic cations, in other words, is recognized as mixed condition of colors derived from each of the contained coloring metallic components. It has been found that when the amount of Pb component in the glaze layer goes down, as a result of the inventor's investigation, specific coloring metallic components such as Cr are easy to make changes in appearing colors (called as "ready discoloring metallic component" hereafter) owing to reaction with the glaze layer reducing the Fb amount. In this case, if the ready discoloring metallic compound is too much, only colors of hues after changing by the ready discoloring metallic compounds become intense, and as a whole, this fact results in intensity of deviation of the tint from the black. It is therefore possible to moderate influences in the tint changing by the ready discoloring metallic component if relatively decreasing the amount of the ready discoloring metallic component accompanied with curtailment of the Pb amount in the glaze. On the other hand, if anticipating what is a hue after changing of the ready discoloring metallic component brought about by said curtailment, it is possible to approach to the black the tint as the whole of the marking layer by compounding, as a blackening adjustment component, the coloring metallic component presenting a hue having a large difference from said hue and hue circles (for example, complementary colors).

When adjusting the composition of the marking layer in accordance with the above mentioned technical concept, attention should be paid to the following points. That is, even in a case of the same transition metallic cation, some differences arise in the spectra of light absorption according to the state of its valency electron. For example, the colors of the transition metallic cation may variously change according to the change of its valency electron state causing by the mutual action between the transitional metallic cation and the ions situated surrounding the transition metallic cations, temperatures or atmosphere of baking the glaze. Such phenomena might occur, of course, in the case that other transition metallic cations are situated surrounding the transition metallic cation being the subject of high absorption, and also in the case that the cations of typical metals such as Al or Zn are situated surrounding the transitional metallic cation. In addition, the cation of the typical metal as the latter sometimes performs as a coloring auxiliary component for the coloring adjustment or stabilization.

For distinguishing the tint of the marking layer as the "Black", a measured value of the chroma of the marking layer should be 3 or lower as an absolute value. Because, if the chroma exceeds 3, it is not easy to erase an impression that the marking layer is apparently colored at seeing an external appearance thereof, irrespective of brightness, and such coloring is heterogeneous from the black. Being over 4, temporarily even if the brightness is very small, the tint is near gray, starting to present an external appearance heterogeneous from the black. As far as being in a range where the brightness is 3 or lower, it may be distinguished as substantially the black until the chroma is around 3, but when the brightness exceeds 3, a coloring is easily sensed to the naked eye by a brightening amount, and therefore with respect to the range where the brightness is 3 to 4, the chroma should be restrained to be 2 or lower.

That the chroma shows not zero but finite values, does not always mean that the "Black" pure in an optical significance is realized. However, if it cannot be confirmed that the chroma presents a tint deviating from the black so far as paying not so much attention, it is difficult to assume that the distinction of kinds by the marking tint is impossible or the tints exceedingly come off from the imaging tints of purchasers. Accordingly, in the object of the invention, tints belonging to ranges of the brightness and the chroma as mentioned above could be regarded as the "Black".

What the tint of the marking is seen does not depend only on absolute values of the brightness or the chroma, but often depend on a case that an apparent tint is relatively influenced by colors of backgrounds. For example, in case an insulator to be a substrate is formed with a white alumina based ceramic and the glaze is finished nearly to be colorless transparent, the background of the marking will present a white. In such a case, if the tint of the marking layer is mixed with components having colors far off from the black, it is ready for outstanding contrast with the white background. For instance, if the color of the background is white and the like, the brightness and the chroma of the marking layer may be sufficient with said range, but for heightening distinguishability as the "Black", it is desirable that the brightness as well as the chroma are to be 2 or less. That the color of the background is white and the like denotes in the present description that the chroma is 1 or lower and the brightness is 9 or higher.

The glaze layer of the small Pb amount is sometimes contained with Zn for securing fluidity when baking the glaze. As many of the coloring metallic components in the marking layer are easy to change colors presented by reaction with Zn component, when the glaze layer has Zn component, the effect of the invention is more exhibited. The amount of Zn component in the glaze layer may be selected in the range of 1 to 25 mol % in terms of, e.g., ZnO. Being less than 1 mol %, coefficient of thermal expansion of the glaze layer is too large, and defects as crazing easily occur. Zn component works to lower a softening point of the glaze, and if it runs short, the baking of the glaze is difficult. On the other hand, being more than 25 mol %, the glaze layer is apt to be opaque owing to devitrification. In the latter case, there arise problems that it is difficult to visually recognize the marking layer in the substrate, or the apparent tint of the marking layer becomes gray and easily comes off from the black.

When the marking layer is colored with the black, it is desirable to select one kind or more of Fe, Cr, Co and Mn as the metallic element components to be contained. Among them, Fe and Mn can, even if being singly used, show a tint near the black, and can be effectively used as a base of black group coloring metallic components. Fe and Mn may be used in single or in combination.

If only using one of Fe or Mn, the tint probably falls within a brown group (a red is mixed as a hue), or makes the color irregular depending on the glaze composition, and it will be sometimes difficult to realize an even and stable black tint. Especially in a case of using Mn, easily tinged with a red group, the tint of the whole marking layer is ready for being the brown group. In this case, if compounding one or both of Cr component and Co component as blackening adjustment components, the tint of the marking layer to be obtained is easily adjusted to be black. This effect is particularly large when combining Fe component and Cr component. For example, when the tint of Fe component contains the red group component and the color comes out, since the Cr component trends to present a green group, it may be inferred from the viewpoint of phenomena that the latter serves as the blackening adjustment component and easily realize the black group colors.

Cr component is easy to change the tint when using the glaze composition of a small Pb amount, and in particular when using the glaze containing Zn, Cr component easily shows a tint containing a red of the brown group. Therefore, for suppressing the tint of the red group derived from Cr, it is preferable that the marking layer is composed such that Fe component is 30 to 60 mass % in terms of $Fe_2O_3$ and Cr component is 10 to 40 mass % in terms of $Cr_2O_3$ for realizing the stable and even black as the tint of the marking layer.

A second structure of the spark plug according to the invention has the marking layer formed on the surface of the insulator and the glaze layer covering the marking layer so that the marking layer can be seen through the glaze layer, and is characterized in that the glaze layer contains Pb component 5 mol % or less in terms of PbO and Zn 1 to 25 mol % in terms of ZnO, and the marking layer contains Fe component 30 to 60 mass % in terms of $Fe_2O_3$, and Cr component 10 to 40 mass %. in terms of $Cr_2O_3$.

If Fe component is less than 30 mass %, it might be difficult to color the marking layer to be a deep black On the other hand, being more than 60 mass %, a margin for containing the blackening adjustment component is made small, and it is difficult to provide the constant and uniform black. In a case of substituting Mn for Fe, a tendency is almost the same, and when using Mn in single or in combination with Fe, a total amount is desirably 30 to 60 mass %. If Cr component is less than 10 mass %, an effect of Cr component as the blackening adjustment is insufficient, and it is difficult to provide the constant and uniform black. Being more than 40 mass %, the tint of the whole marking layer deviates from the black (for example, the marking layer is tinged with the red group color and falls within the brown group), and in turn the brightness and the chrome are easily off from said range. More preferably, the marking layer contains Cr component 10 to 25 mass % in terms of $Cr_2O_3$.

The marking layer can contain Co component 10 to 40 mass % in terms of CoO This component trends to color a blue group of the tint far-off from the red, and when using Fe or Mn as the black group coloring metallic component, Co component usefully works as the blackening adjustment component under a condition where the red group color is easy to mix. Being less than 10 mass %, the effect will be insufficient, and the tint of the whole marking layer deviates from the black.

When the red group hue is easily developed owing to a reaction of the Cr component and Zn component, if Co component is added to supplement blue group colors, the tint of the whole marking layer can be brought more nearly to the black. In this case, it is desirable that Cr component and Co component are contained 10 to 40 mass % in total.

The marking layer can further contain Ni component 0.5 to 15 mass % in terms of $Ni_2O_3$. Ni component also usefully works as the blackening adjustment component, and for example, when Zn is contained in the glaze layer, Ni component shows a coloring effect of the blue group owing to the reaction with Zn, and a coloring adjustment effect similar to Co can be expected. But being less than 0.5 mass %, the effect will be insufficient, and being more than 15 mass %, the tint of the whole marking layer deviates from the black.

In addition, the marking layer can contain at least one of Al component and Ba component 0.5 to 15 mass % in total in terms of $Al_2O_3$ or BaO. These components are effective for accelerating colors of other coloring metallic components contained in the marking layer. But being less than 0.5 mass %, the effect will be insufficient, and being more than 15 mass %, an effect more than that cannot be expected, and the whole amount of the coloring metallic components relatively decrease, so that it will be difficult to color the marking layer in an enough darkness.

Incidentally, aiming at the coloring adjustment, the coloring acceleration, or the homogenization and stabilization of colors other than the above mentioned effects, the marking layer can contain one kind or more of V, Sn, Zn, Ti, Zr, Na, Mg, Si, K, and Ca within the range of 5 wt % in terms of $V_2O_3$ $SnO_2$, ZnO, $TiO_2$, $ZrO_2$, $Na_2O$, MgO, $SiO_2$, $K_2O$ and CaO, respectively.

Thickness of the marking layer is preferably 1 to 10 $\mu$m. Being less than 1 $\mu$m, the color of the substrate easily appears, and the tint of the marking layer comes off from the black. On the other hand, being more than 10 $\mu$m, irregularities derived from the marking layer are outstanding in the insulator surface to spoil the external appearance.

Figure 1:
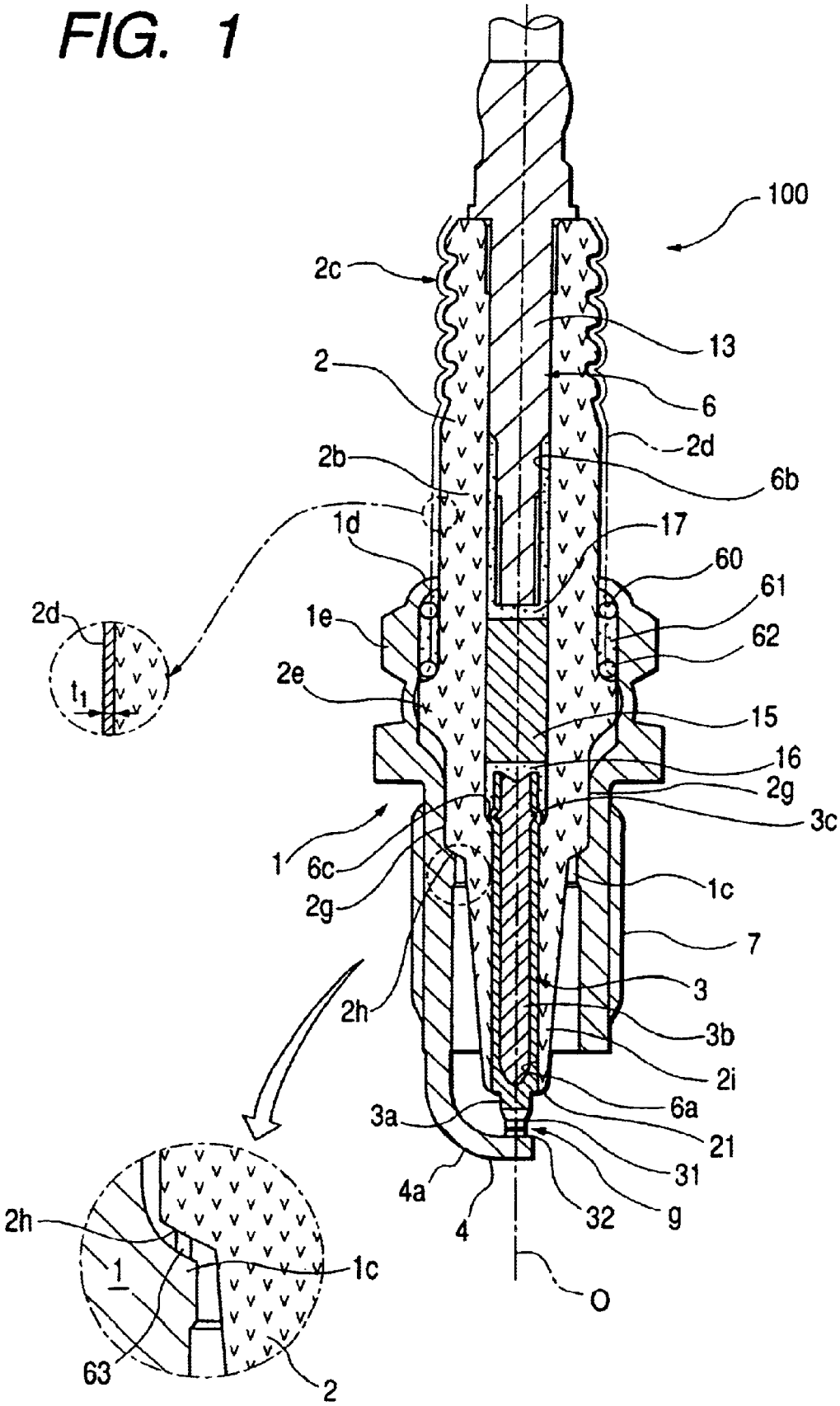
FIG. 1 is a whole front and cross sectional view showing one example of the spark plug according to the invention.

The reference numerals used in the drawings are shown below.

1: Metal shell

2: Insulator

2*d*: Glaze layer

2*m*: Marking layer

3: Center electrode

4: Ground electrode.

DETAILED DESCRIPTION OF THE INVENTION

Modes for carrying out the invention will be explained with reference to the accompanying drawings. FIG. 1 shows an example of the spark plug of the first structure according to the invention. The spark plug 100 has a cylindrical metal shell 1, an insulator 2 fitted in the inside of the metal shell 1 with its tip 21 projecting from the front end of the metal shell 1, a center electrode 3 disposed inside the insulator 2 with its ignition part 31 formed at the tip thereof, and a ground electrode 4 with its one end welded to the metal shell 1 and the other end bent inward such that a side of this end may face the tip of the center electrode 3. The ground electrode 4 has an ignition part 32 which faces the ignition part 31 to make a spark gap g between the facing ignition parts.

The metal shell 1 is formed to be cylindrical of such as a low carbon steel. It has a thread 7 therearound for screwing the spark plug 100 into an engine block (not shown) Symbol le is a hexagonal nut portion over which a tool such as a spanner or wrench fits to fasten the metal shell 1.

The insulator 2 has a through-hole 6 penetrating in the axial direction. A terminal fixture 13 is fixed in one end of the through-hole 6, and the center electrode 3 is fixed in the other end A resistor 15 is disposed in the through-hole 6 between the terminal metal fixture 13 and the center electrode 3. The resistor 15 is connected at both ends thereof to the center electrode 3 and the terminal metal fixture 13 via the conductive glass seal layers 16 and 17, respectively. The resistor 15 and the conductive glass seal layers 16, 17 constitute the conductive sintered body. The resistor 15 is formed by heating and pressing a mixed powder of the glass powder and the conductive material powder (and, if desired, ceramic powder other than the glass) in a later mentioned glass sealing step. The resistor 15 may be omitted, and the terminal metal fixture 13 and the center electrode 3 may be directly connected via one seal layer of the conductive glass seal.

The insulator 2 has the through-hole 6 in its axial direction for fitting the center electrode 3, and is formed as a whole with an insulating material as follows. That is, the insulating material is mainly composed of an alumina ceramic sintered body having an Al content of 85 to 98 mass % (preferably 90 to 98 mass %) in terms of $Al_2O_3$.

The specific components other than Al are exemplified as follows.

Si component: 1.50 to 5.00 mass % in terms of $SiO_2$;

Ca component: 1.20 to 400 mass % in terms of CaO;

Mg component: 0.05 to 0.17 mass % in terms of MgO;

Ba component: 0.15 to 0.50 mass % in terms of BaO; and

B component: 0.15 to 0.50 mass % in terms of $B_2O_3$.

Figure 2:
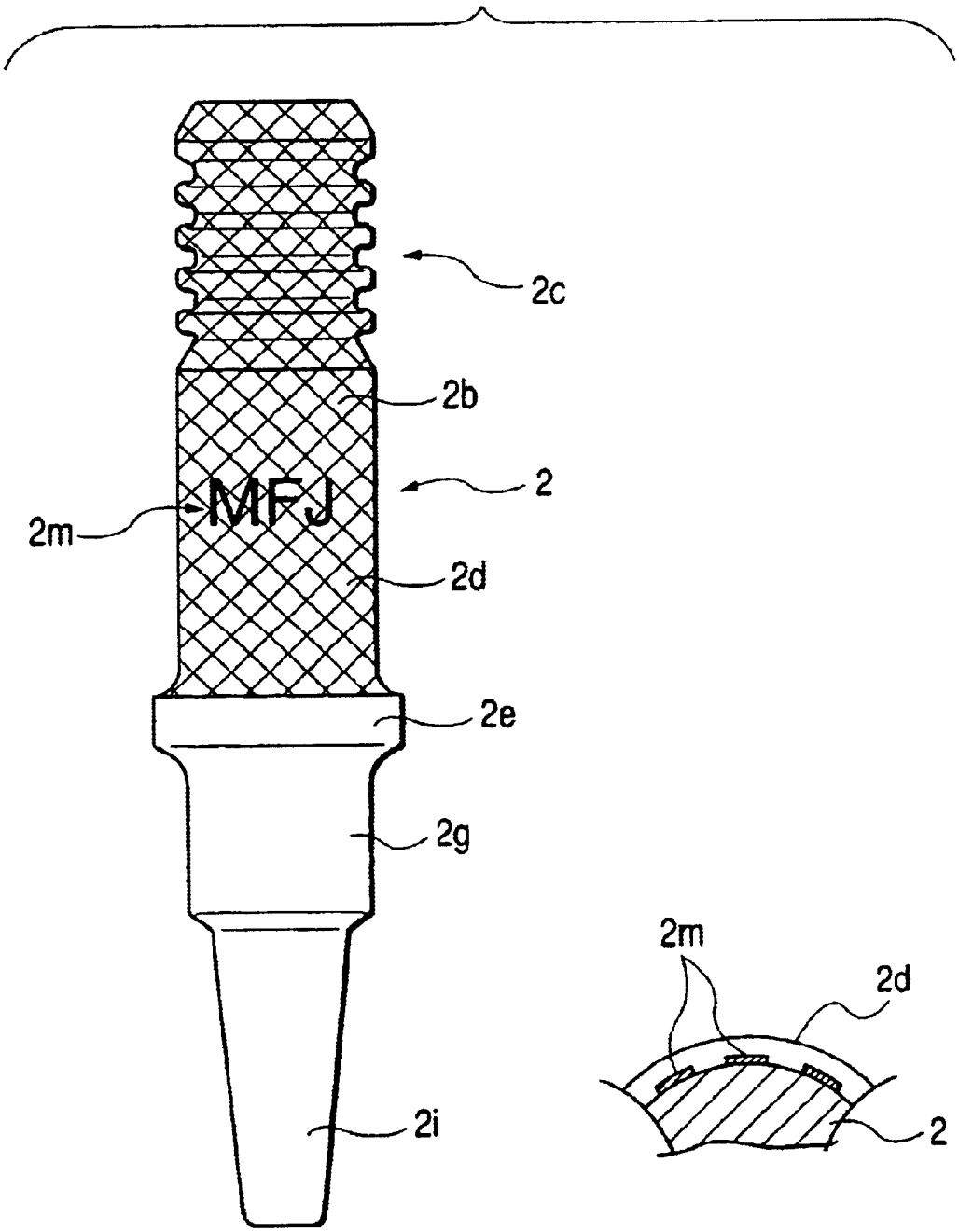
FIG. 2 is a front view showing an external appearance of in insulator together with the glaze layer.

FIG. 2 shows the insulator 2 only. The insulator 2 has a projection 2*e* projecting outwardly, e.g., flange-like on its periphery at the middle part in the axial direction, a rear portion 2*b* whose outer diameter is smaller than the projecting portion 2*e*, a first front portion 2*g* in front of the projecting portion 2*e*, whose outer diameter is smaller than the projecting portion 2*e*, and a second front portion 2*i* in front of the first front portion 2*g*, whose outer diameter is smaller than the first front portion 2*g*. The rear end part of the rear portion 2*b* has its periphery corrugated to form corrugations 2*c*. The first front portion 2*g* is almost cylindrical, while the second front portion 2*i* is tapered toward the tip 21.

Turning back to FIG. 1, the center electrode 3 has a smaller diameter than that of the resistor 15. The through-hole 6 of the insulator 2 is divided into a first portion 6*a* (front portion) having a circular cross section in which the center electrode 3 is fitted and a second portion 6*b* (rear portion) having a circular cross section with a larger diameter than that of the first portion 6*a*. The terminal metal fixture 13 and the resistor 15 are disposed in the second portion 6*b*, and the center electrode 3 is inserted in the first portion 6*a*. The center electrode 3 has an outward projection 3*c* around its periphery near the rear end thereof, with which it is fixed to the electrode. A first portion 6*a* and a second portion 6*b* of the through-hole 6 are connected each other in the first front portion 2*g*, and at the connecting part, a projection receiving face 6*c* is tapered or rounded for receiving the projection 3*c* for fixing the center electrode 3.

The first front portion 2*g* and the second front portion 2*i* of the insulator 2 connect at a connecting part 2*h*, where a level difference is formed on the outer surface of the insulator 2. The metal shell 1 has a projection 1*c* on its inner wall at the position meeting the connecting part 2*h* so that the connecting part 2*h* fits the projection 1*c* via a gasket ring 63 thereby to prevent slipping in the axial direction. A gasket ring 62 is disposed between the inner wall of the metal shell 1 and the outer side of the insulator 2 at the rear of the flange-like projecting portion 2*e*, and a gasket ring 60 is provided in the rear of the gasket ring 62. The space between the two gaskets 60 and 62 is filled with a filler 61 such as talc. The insulator 2 is inserted into the metal shell 1 toward the front end thereof, and under this condition, the rear opening edge of the metal shell 1 is pressed inward the gasket 60 to form a sealing lip 1*d*, and the metal shell 1 is secured to the insulator 2.

As shown in FIG. 2, the glaze layer 2*d* is formed on the outer surface of the insulator 2, more specifically, on the outer peripheral surface of the rear portion 2*b* inclusive of the corrugated part 2*c*. As shown in FIG. 1, the glaze layer 2*d* formed on the rear portion 2*b* extends in the front direction farther from the rear end of the metal shell 1 to a predetermined length, while the rear side extends till the rear end edge of the rear portion 2*b*.

The glaze layer 2*d* contains, for example, Zn 1 to 25 mol % in terms of Zno and Pb 5 mol % or lower in terms of PbO, e.g., 1 mol %. On the other hand, the insulator 2 of the main body part 2*b* is formed on the surface with the marking layer 2*m*, which is covered with the glaze layer 2*d* so that the marking layer 2*m* can been seen through the glaze layer 2*d*. The marking layer 2*m* is composed of a main oxide of the metallic component being cation as explained in the Summary of the Invention. The kinds and amounts of the metallic element components contained in the marking layer are adjusted in such manners that the tint of the marking layer 2*m* seen through the glaze layer 2*m* is 3 or less in the brightness specified by JIS:Z8721, and 3 or less in the chroma, otherwise 4 or less in the brightness as well as 2 or less in the chroma Specifically, the components of Fe, Mn, Cr, Co, Al or Ba are contained in the abovementioned composition range, and the thickness is around 1 to 10 $\mu$m.

The glaze layer 2*d* may employ such substances which contain 35 to 80 mol % a first component comprising Si component of 5 to 60 mol % in terms of $SiO_2$ and B component of 3 to 50 mol % and a second component comprising at least any one of Zn in terms of ZnO and alkaline earth metal component R (R is one or two kinds or more selected from Ca, Sr and Ba) in terms of RO, and the total amount of the first component and the second component is 65 to 98 mol %, and the alkaline metal component is one or two kinds or more of Na in terms of $Na_2O$, K in terms of $K_2O$ and Li in terms of $Li_2O$ 2 to 15 mol % in total. A thickness of the glaze layer 2*d* is, e.g., 7 to 150 $\mu$m, desirably 10 to 50 $\mu$m. In particular, the thickness tg (average value) of the glaze layer 2*d* on the outer circumference of the base of the rear portion 2*b* (the cylindrical and non-corrugated outer circumference part 2*c* projecting downward from the metal shell 1) is 7 to 50 $\mu$m.

If Si in the glaze layer 2*d* is less than 5 mol %, the vitrification is difficult and the formation of the even glaze layer 2*d* is impossible. In contrast, being more than 60 mol %, coefficient of linear expansion of the glaze is too small, and defects such as cracking or glaze splashing are easy to occur in the glaze layer 2*d*. The softening point of the glaze goes up exceedingly, resulting in lowering of the fluidity when baking the glaze to invite poor melting of the glaze. For settling this problem, if heightening temperature of baking the glaze, reaction between the glaze layer 2*d* and the marking layer 2*m* is intensive, and it might be difficult to make the marking layer 2*m* the desired black.

The amount of B component is determined to be 3 to 50 mol % in terms of $B_2O_3$. Being less than 3 mol %, the softening point of the glaze goes up, and the glaze baking is difficult or impossible. For settling this problem, if heightening temperature of baking the glaze, the reaction between the glaze layer 2*d* and the marking layer 2*m* is intensive, and it might be difficult to make the marking layer 2*m* the desired black.

On the other hand, being more than 50 mol %, stability of a glaze slurry for forming the glaze layer 2*d* is insufficient, and there occur problems such as devitrification of the glaze layer 2*d*, reduction of insularity or maladjustment in coefficient of linear expansion with the substrate.

If the total amount of the second component composed of Zn component and/or alkaline earth metal component R is less than 5 mol %, the softening point of the glaze increases and the glaze baking at desired temperature might be impossible. The insularity of the glaze layer 2*d* will be insufficient, and anti flashover property is probably spoiled. If the total amount of the second component exceeds 60 mol %, the softening point of the glaze increases and the glaze baking at desired temperature might be impossible. Further, coefficient of linear expansion of the glaze is too large, and consequently defects such as crazing easily occur. As to the total amount of the first and second components, if exceeding 98 mol %, the softening point of the glaze increases, and the glaze baking is impossible. Being less than 60 mol %, compatibility between the insularity and the softening point as well as the adjustment of linear expansion coefficient is difficult. The total amount is desirably 70 to 95 mol %. Alkaline metal component in the glaze works to lower the softening point of the glaze. If the amount thereof is less than 2 mol %, the softening point goes up and the glaze baking will be impossible. Being more than 15 mol %, the insularity of the glaze is decreased, and anti flash over property is probably spoiled. Thus, the amount of alkaline metal component is desirably 3 to 10 mol %.

As to alkaline metal component, two kinds selected from Na, K, Li are added more effectively for controlling reduction of the insularity of the glaze layer 2*d* than one kind is added in single. As a result, the amount of alkaline metal component can be increased without so much deterioration in the insularity, and consequently it is possible to concurrently accomplish the two objects of securing the anti-flashover property and lower the glaze baking temperature. By the way, it is possible to compound other alkaline metal components than a third component and subsequent components in ranges of not spoiling the effect of controlling conductivity by co-addition of alkaline metal component.

The containing amounts of the respective components in the marking layer 2*m* and the glaze layer 2*d* formed on the insulator 2 can be identified by use of known micro-analyzing methods such as EPMA (electronic probe micro-analysis) or XPS (X-ray photoelectron spectroscopy). For example, if using EPMA, either of a wavelength dispersion system and an energy dispersion system is sufficient for measuring characteristic X-ray. Further, there is a method where the glaze layer is peeled from the insulator and is subjected to a chemical analysis or a gas analysis for identifying the composition.

The softening point of the glaze layer 2*d* is preferably adjusted to range, e.g., 700° C. or lower. When the softening point is higher than 700° C., the reaction between the glaze layer 2*d* and the marking layer 2*m* easily progresses, and the marking layer 2*m* runs or discolors. With respect to the softening point of the glaze, for example, a differential thermal analysis is carried out while peeling the glaze layer 2*d* from the insulator 2 and heating it, and a temperature of a peak (a second endothermic peak) appearing next to a first endothermic peak showing a bowing point is determined to be the softening point. Further, as to the softening point of the glaze layer 2*d* formed in the surface of the insulator 2, the amounts of the respective components in the glaze layer 2*d* are respectively analyzed to calculate compositions in terms of oxides, and oxide raw materials of respective oxidized element components compounded, melted, and rapidly cooled to produce glass samples, and with the softening point of the glass sample, the softening point of the formed glaze layer 2*d* may be assumed.

The ground electrode 4 and the core 3*a* of the center electrode are made of a Ni alloy. Ignition parts 31, 32 mainly made of noble metal alloys of one or two kinds or more of Ir, Pt and Rh being main, are formed by such as welding. The core 3*a* of the center 3 is buried inside with a core 3*b* composed of Cu or Cu alloy for accelerating heat dissipation. At least one of the ignition part 31 and the opposite ignition part 32 may be omitted.

The spark plug 100 can be produced as follows. In preparing the insulator 2, an alumina powder is mixed with raw material powders of a Si component, Ca component, Mg component, Ba component, and B component in such a mixing ratio as to give the aforementioned composition after sintering, and the mixed powder is mixed with a prescribed amount of a binder (e.g., PVA) and a water to prepare a slurry. The raw material powders include, for example, $SiO_2$ powder as the Si component, $CaCO_3$ powder as the Ca component, MgO powder as the Mg component, $BaCO_3$ as the Ba component, and $H_3PO_3$ as to the B component. $H_3BO_3$ may be added in the form of a solution.

A slurry is spray-dried into granules for forming a base, and the base forming granules are rubber-pressed into a pressed body a prototype of the insulator. The formed body is processed on an outer side by grinding to the contour of the insulator 2 shown in FIG. 2, and then baked 1400 to 1600° C. to obtain the insulator 2.

Figure 3:
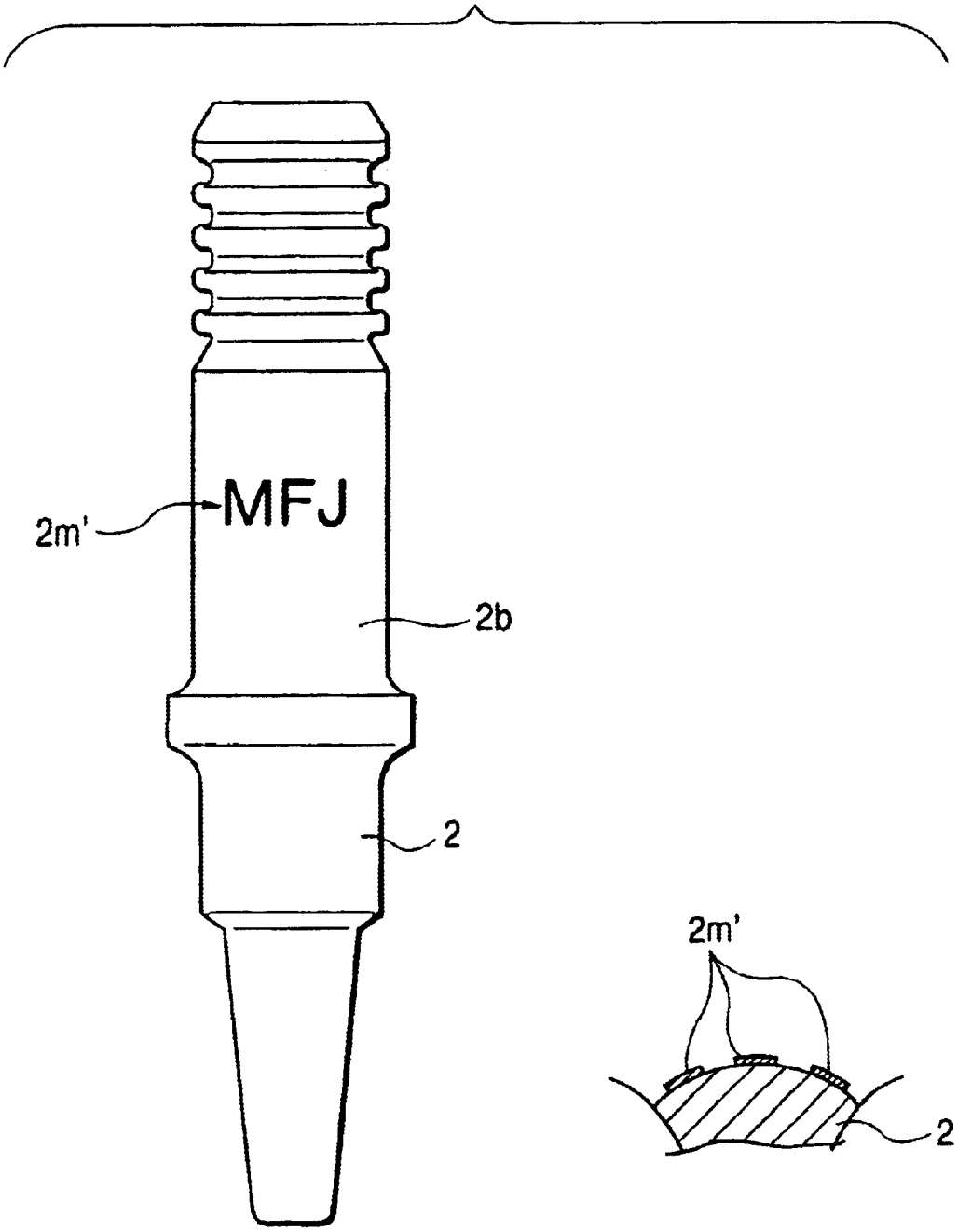
FIG. 3 is an explanatory view of a forming process of the printed layer.

As seen in FIG. 3, on an outer periphery of the main body 2*b* of the insulator 2, a printed layer 2*m*' is formed for providing the marking layer. As a printing ink, such substances are available that raw material of oxide powder containing coloring metallic component such as a pigment is compounded with a solvent and an organic binder or a viscosity adjusting agent. This ink is used to print desired patterns on the surface of the insulator 2 prior to forming the glaze layer 2*d*. Average diameter of the raw material oxide powder is preferable, for example, 0.3 to 2.0 $\mu$m. Being less than 0.3 $\mu$m, the pigment component to the glaze layer is apt to disperse to cause the color to run. Being more than 2 $\mu$m, the viscosity of the ink is too high, and the coated thickness of the printed layer 2*m* becomes irregular.

Next, the glaze slurry is prepared as follows. Raw material powders as sources of Si, B, Zn, Ba, and alkaline components (Na, K, Li) (for example, $SiO_2$ powder for the Si component, $H_3PO_3$ powder for the B component, ZnO powder for the Zn component, $BaCO_3$ powder for the Ba component, $Na_2CO_3$ powder for the Na component, $K_2CO_3$ powder for the K component, and $Li_2CO_3$ powder for the Li component) are mixed for obtaining a predetermined composition The mixed powder is heated and melted 1000 to 1500° C., and thrown into the water to rapidly cool for vitrification, followed by grinding to prepare a glaze fritz. The glaze fritz is mixed with appropriate amounts of clay mineral, such as kaolin or gairome clay, and organic binder, and the water is added thereto to prepare the glaze slurry.

Figure 4:
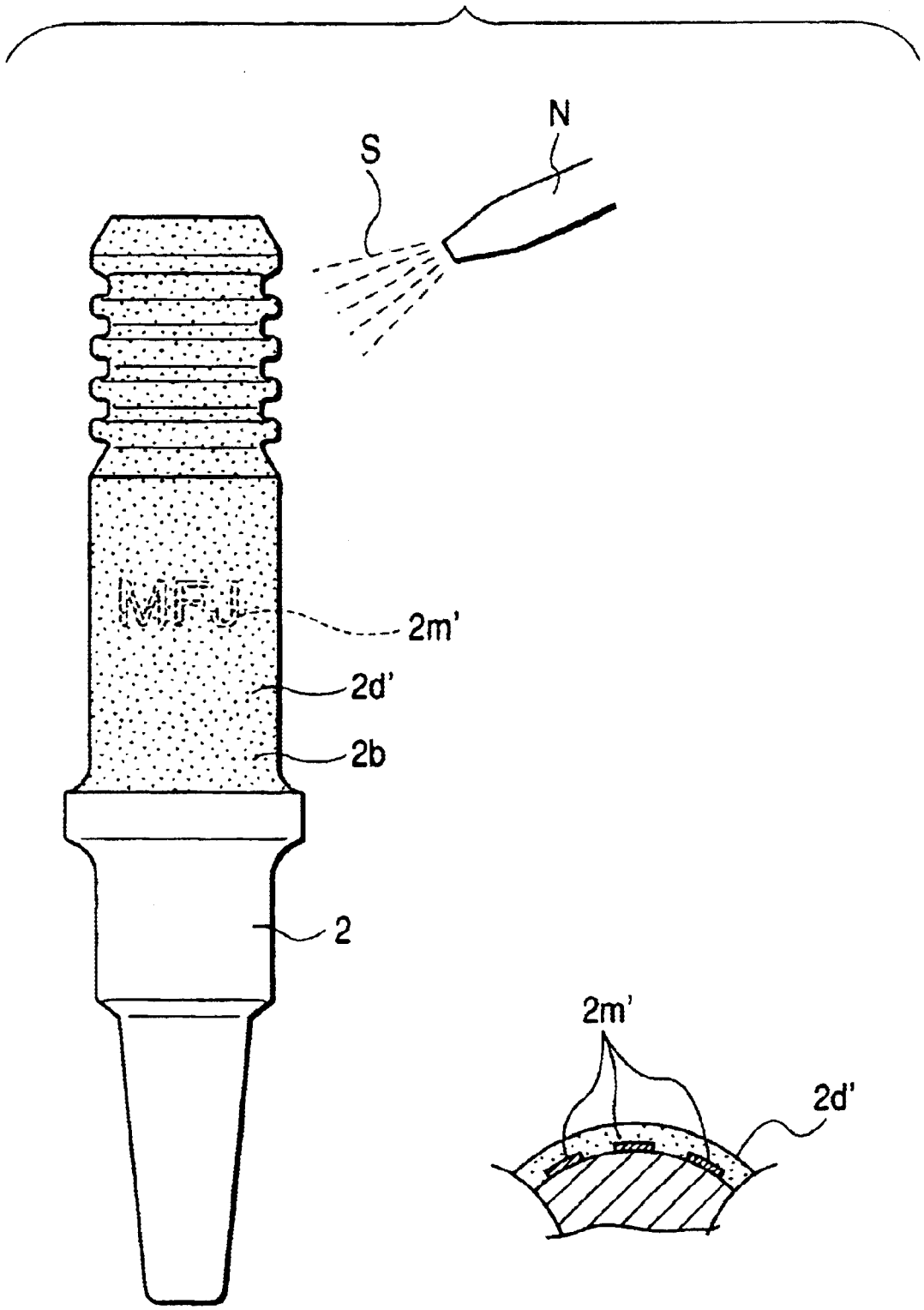
FIG. 4 is an explanatory view of a forming process of the coated layer of the glaze slurry.

As shown in FIG. 4, the glaze slurry S is sprayed from a nozzle N to coat a requisite surface of the insulator 2, thereby to form a coated layer 2*d*' of the glaze slurry as the piled layer of the glaze powder. The previously formed printed layer 2*m* is covered with a coated layer 2*d*' of the glaze slurry.

Figure 5D:
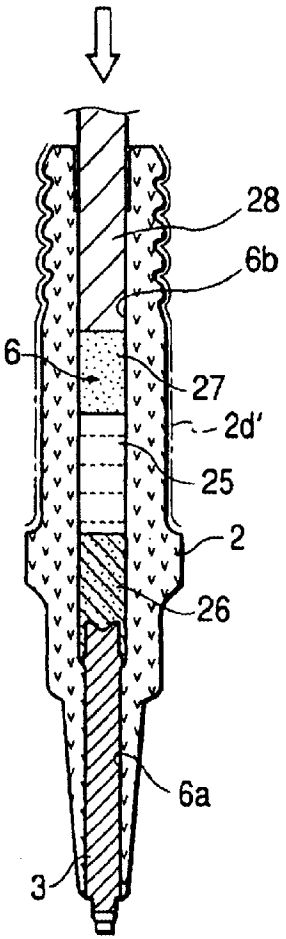
FIG. 5 is an explanatory view of the glass sealing process.
Figure 5C:
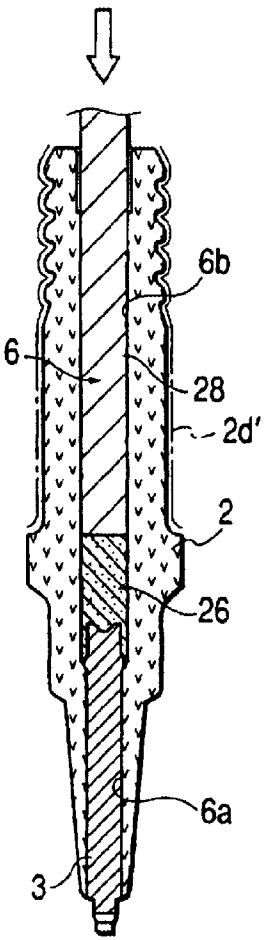
Figure 5B:
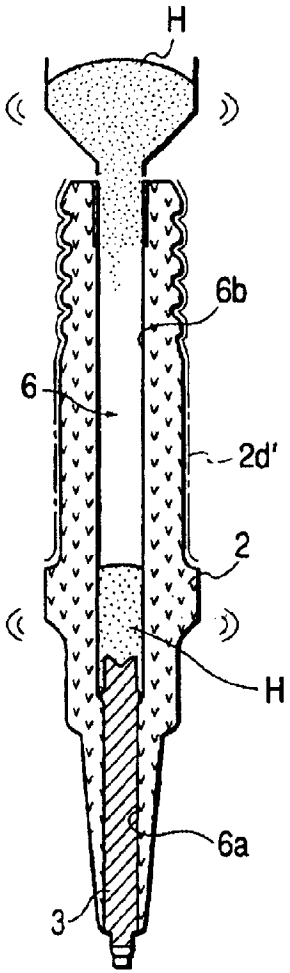
Figure 5A:
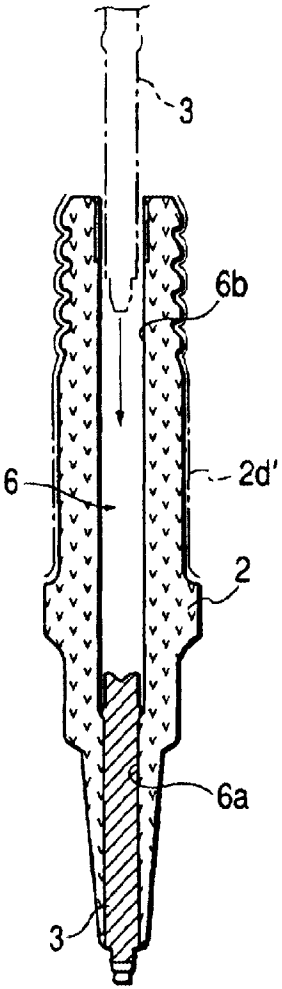

The center electrode 3 and the terminal metal fixture 13 are fitted in the insulator 2 formed with the glaze slurry coated layer 2*d*' as well as the resistor 15 and the electrically conductive glass seal layers 16, 17 are formed as follows. As shown in FIG. 5A, the center electrode 3 is inserted into the first portion 6*a* of the through-hole 6. A conductive glass powder H is filled as shown in FIG. 5B. The powder H is, as shown in FIG. 5C, preliminarily compressed by pressing a press bar 28 into the through-hole 6 to form a first conductive glass powder layer 26. A raw material powder for a resistor composition is filled and preliminary compressed in the same manner, so that, as shown in FIG. 5D, the first conductive glass powder 26, the resistor composition powder layer 25 and a second conductive glass powder layer 27 are laminated from the center electrode 3 (lower side) into the through-hole 6.

Figure 6A:
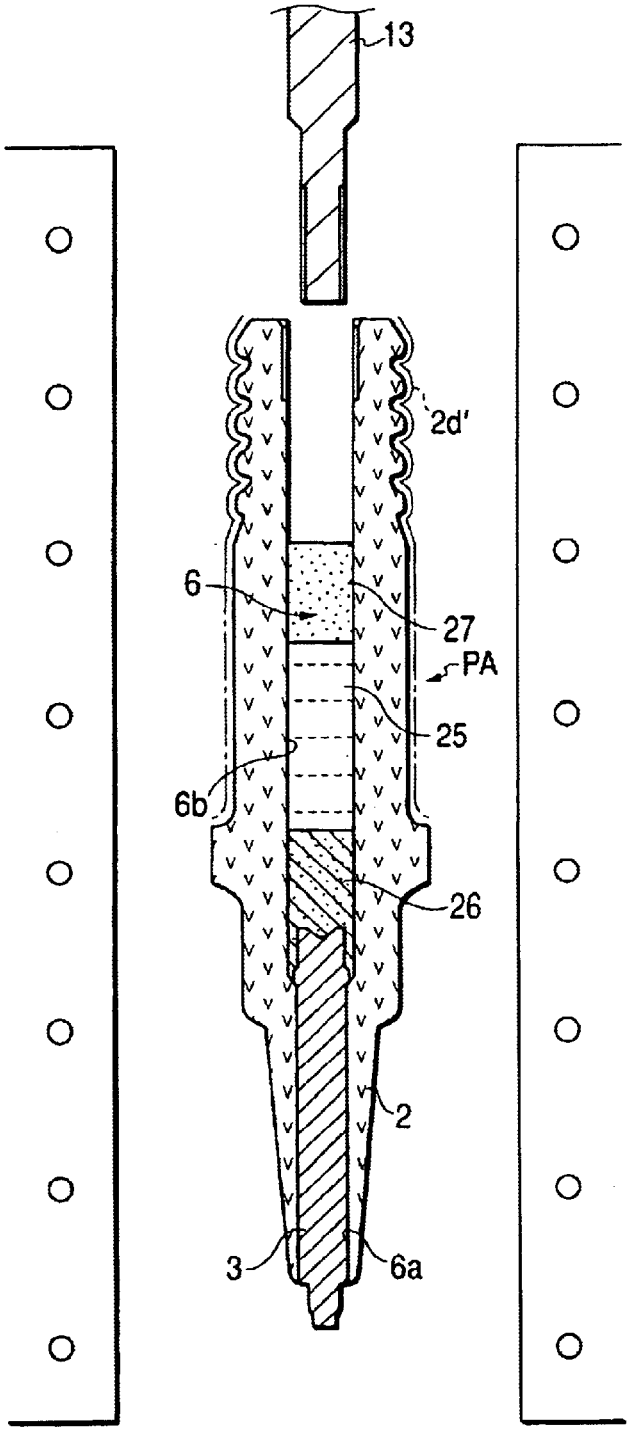
FIG. 6 is an explanatory view continued from FIG. 5.
Figure 6B:
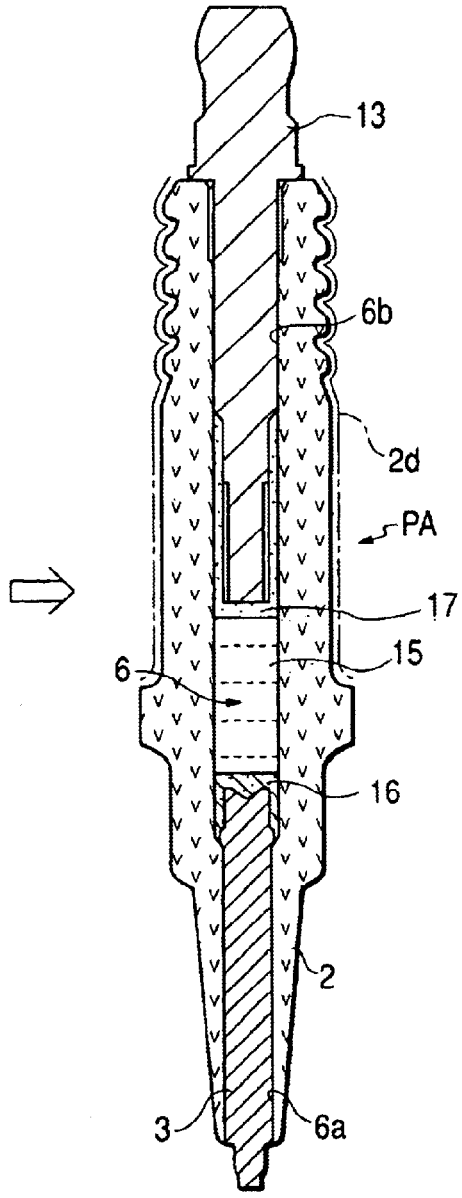

An assembled structure PA is formed where the terminal metal fixture 13 is disposed from the upper part into the through-hole 6 as shown in FIG. 6A. The assembled structure PA is put into a heating oven and heated at a predetermined temperature of 800 to 950° C. being above the glass softening point, and then the terminal metal fixture 13 is pressed into the through-hole 6 from a side opposite to the center electrode 3 so as to press the superposed layers 25 to 27 in the axial direction. Thereby, as seen in FIG. 6B, the layers are each compressed and sintered to become a conductive glass seal layer 16, a resistor 15, and a conductive glass seal layer 17 (the above is the glass sealing step).

If the softening point of the glaze frit contained in the glaze slurry coated layer 2*d*' is set to be 600 to 700° C., the layer 2*d*' can be baked, at the same time as the heating in the above glass sealing step, into the glaze layer 2*d*. Since the heating temperature of the glass sealing step is selected from the relatively low temperature of 800 to 950° C., oxidation to surfaces of the center electrode 3 and the terminal metal fixture 13 can be made less. Accompanied with the glaze baking of the glaze slurry coated layer 2*d*', the printed layer 2*m*' (FIG. 3) is also sintered to turn out the marking layer 2*m*. The solvent or the organic component in the printed layer 2*m*' are burnt and expelled. The glaze slurry coated layer 2*d*' is melted together with the glaze baking and becomes the transparent and vitreous (glassy) glaze layer 2*d* so that the downside marking layer 2*m* can be seen through the glaze layer. If adjusting the composition of the marking layer 2*m* as mentioned above, the reaction taking place in relation with the glaze layer 2*d* of the low Pb amount and relatively high Zn component is restrained, and the external appearance of the marking layer 2*m* can be stably recognized as the black.

After the glass sealing step, the metal shell 1, the ground electrode 4 and others are fitted on the structure PA to complete spark plug 100 shown in FIG. 1. The spark plug 100 is screwed into an engine block using the thread 7 thereof and used as a spark source to ignite an air/fuel mixture supplied to a combustion chamber.

For confirmation of the effects according to the invention, the following experiments were carried out.

(Experiment 1)

The insulator 2 was made as follows Alumina powder (alumina content: 95 mass %; Na content (as $Na_2O$): 0.1 mass %; average particle size: 3.0 μm) was mixed at a predetermined mixing ratio with $SiO_2$ (purity: 99.5%; average particle size: 1.5 μm), $CaCO_3$ (purity: 99.9%; average particle size: 2.0 μm), MgO (purity: 99.5%; average particle size: 2 μm) $BaCO_3$ (purity: 99.5%; average particle size: 1.5 μm), $H_3BO_3$ (purity: 99.0; average particle size 1.5 μm), and ZnO (purity: 99.5, average particle size: 2.0 μm). To 100 mass parts of the resulting mixed powder were added 3 mass parts of PVA as a hydrophilic binder and 103 mass parts of water, and the mixture was kneaded to prepare a slurry.

The resulting slurry was spray-dried into spherical granules, which were sieved to obtain fraction of 50 to 100 μm. The granules were formed under a pressure of 50 MPa by a rubber-pressing method. The outer surface of the formed body was machined with the grinder into a predetermined figure and baked at 1550° C. to obtain the insulator 2. The X-ray fluorescence analysis revealed that the insulator 2 had the following composition.

Al component (as $Al_2O_3$): 94.9 mass %;

Si component (as $SiO_2$) 2.4 mass %;

Ca component (as CaO): 1.9 mass %;

Mg component (as MgO): 0.1 mass %;

Ba component (as BaO): 0.4 mass %; and

B component (as $B_2O_3$) 0.3 mass %.

Next, the glaze slurry was prepared as follows. $SiO_2$ powder (purity: 99.5), $Al_2O_3$ powder (purity: 99.5%), $H_3BO_3$ powder (purity: 98.5%), $Na_2CO_3$ powder (purity: 99.5%) $K_2CO_3$ powder (purity: 99%) $Li_2CO_3$, powder (purity: 99%) $BaSO_4$ powder (purity: 99.5%), $SrCO_3$ powder (purity: 99%) ZnO powder (purity: 99.5%), $MoO_3$ powder (purity: 99%), CaO powder (purity: 99.5%), $TiO_2$ powder (purity: 99.5%), $ZrO_2$ powder (purity: 99.5%), $HfO_2$ powder (purity: 99%) MgO powder (purity: 99.5%), and PbO powder (purity: 99%) were mixed. The mixture was melted 1000 to 1500° C., and the melt was poured into the water and rapidly cooled for vitrification, followed by grinding in an alumina pot mill to powder of 50 μm or smaller to produce the glaze frit. 3 mass parts of New Zealand kaolin as clay mineral and 2 mass parts of PVA as an organic binder were mixed into 100 mass parts of the glaze frit, and the mixture was kneaded with 100 mass parts of the water to prepare two kinds of the glaze slurry. The glaze samples solidified in mass were used to analyze the chemical composition of the glaze. The analyzed a results are as follows.

(The Glaze Composition 1)

$SiO_2$: 28.5 mol %

$B_2O_3$: 28.5 mol %

ZnO: 15.8 mol %

BaO: 5.5 mol %

$Na_2O$: 2.2 mol %

$K_2O$: 5.4 mol %

$Li_2O$: 3.0 mol %

$Al_2O_3$: 2.4 mol %

$MoO_3$: 0.5 mol %

$ZrO_2$: 1.2 mol %

MgO: 1.1 mol %

$TiO_2$: 0.7 mol %

CaO: 3.3. mol %

(The Glaze Composition 2)

$SiO_2$: 29.5 mol %

$B_2O_3$: 30.1 mol %

ZnO: 13 mol %

BaO: 3 mol %

SrO: 2.2 mol;

$Na_2O$: 1.4 mol %

$K_2O$: 5.1 mol %

$Li_2O$: 3.0 mol %

$Al_2O_3$: 1.5 mol %

$MoO_3$: 0.5 mol %

$ZrO_2$: 1.2 mol %

MgO: 3.3 mol %

PbO: 6.2 mol %

The inks of respective kinds of the compositions for forming the marking layer were prepared as follows.

The raw materials of oxide were compounded in order to provide the respective compositions of Table 1, temporarily baked at 500 to 1000° C., and pulverized to be 1 μm or lower as the average diameter in a trommel mill. The pulverized powder was added with varnish and alkyd resin of appropriate amounts, mixed, and kneaded in a roll mill to produce the ink.

The above mentioned ink was used to form the printed layer 2*m*' of thickness being 2 μm on the surface of the insulator 2. After drying, the glaze slurry (the glaze composition 1) was sprayed on the insulator 2 from the spray nozzle as illustrated in FIG. 4, and dried to form the coated layer 2*d*' of the glaze slurry having a coated thickness of about 100 μm. Several kinds of the spark plug 100 shown in FIG. 1 were produced by using the insulator 2. The outer diameter of the thread 7 was 14 mm. The resistor 15 was made of the mixed powder consisting of $B_2O_3$—$SiO_2$—BaO—$LiO_2$ glassy powder, $ZrO_2$ powder, carbon black powder, $TiO_2$ powder, and metallic Al powder. The electrically conductive glass seal layers 16, 17 were made of the mixed powder consisting of $B_2O_3$—$SiO_2$—$Na_2O$ glassy powder, Cu powder, Fe powder, and Fe—B powder. The heating temperature for the glass sealing, i.e., the glaze baking temperature was set at 900° C.

The tint of the marking layer 2*m* seen through the baked glaze layer 2*d* was visually confirmed and visually compared with standard color chips made in accordance with JIS:Z8721 by observation through a magnifying glass using a white light source so as to measure the brightness and the chroma. With respect to test products finishing the tint confirmation, the respective compositions of the glaze layer 2*d* formed on the surface of the insulator 2 were measured by EPMA. In addition, by the EPMA analysis in the cross sections, the compositions of the marking layer were analyzed. The above results are shown in Table 1 (the composition is shown in terms of oxide).

Although the glaze layer hardly contains Pb component and the amount of Zn component is relatively high, if the compositions of the marking layer is adjusted, it is seen that the tints of the black group of the brightness and chroma being both 3 or lower are stably realized. In regard to the ink No 3 having the marking layer in reddish brown, the same experiment was performed with the glaze slurry of the glaze composition 2 containing Pb, the results were brightness of 3 and chroma of 2 and the black was presented without problem.

The entire disclosure of each and every foreign patent application from which the benefit of foreign priority has been claimed in the present application is incorporated herein by reference, as if fully set forth herein.

We claim:

1. A spark plug comprising:

an insulator;

a marking layer is between 1 and 10 μm and formed on a surface of the insulator; and a glaze layer covering the marking layer so that the marking layer can be seen through the glaze layer, wherein the glaze layer is between 10 and 50 μm and comprises 5 mol % or less of a Pb component in terms of PbO, and the tint of the marking layer seen through the glaze layer is 3 or less in brightness as specified by 1993 JIS: Z8721 as well as 3 or less in the chroma as specified by 1993 JIS: Z8721.

2. A spark plug comprising:

an insulator;

a marking layer is between 1 and 10 μm and formed on a surface of the insulator; and a glaze layer covering the marking layer so that the marking layer can be seen through the glaze layer, wherein the glaze layer is between 10 and 50 μm and comprises 5 mol % or less of a Pb component in terms of PbO, and the tint of the marking layer seen through the glaze layer is 4 or less in brightness as specified by 1993 JIS: Z8721 as well as 2 or less in chroma as specified by 1993 JIS: Z8721.

3. The spark plug as set forth in claim 1 or 2, wherein the glaze layer further comprises a Zn component.

TABLE 1

| | 1 | 2 | 3 | 4 | 5 | 6 | 7 | 8 | 9 | 10 |
|---|---|---|---|---|---|---|---|---|---|---|
| A | | | | | | | | | | |
| Fe2O3 | 46 | 38 | 40 | 38 | 55 | 25 | 57 | 40 | 75 | 50 |
| Cr2O3 | 20 | 20 | 42 | 37 | 8 | 31 | 12 | 12 | 5 | 35 |
| Al2O3 | 3 | 3 | 2 | 5 | 8 | 6 | 8 | 6 | 16 | 10 |
| CoO | 25 | 25 | 11 | 11 | 23 | 23 | 18 | 38 | — | — |
| Ni2O3 | 5 | 13 | 2 | 6 | 4 | 7 | 4 | 3 | — | — |
| SiO2 | 1 | 1 | 1 | 1 | 2 | 4 | 1 | 1 | 4 | 5 |
| CaO | — | — | 2 | 2 | — | 4 | — | — | — | — |
| Total | 100 | 100 | 100 | 100 | 100 | 100 | 100 | 100 | 100 | 100 |
| Average diameter | 0.7 μm | 0.7 μm | 0.7 μm | 0.7 μm | 0.7 μm | 0.7 μm | 0.7 μm | 0.7 μm | 0.7 μm | 2.2 μm |
| Judgment of external appearance of marking layer | Very Good ○○ | Good ○ | Reddish brown x | Good ○ | Not to be black x | Coloring: Bad (Color running) x | Good ○ | Good ○ | Not to be black x | Good (Slightly bad coloring) Δ |
| Brightness | 2 | 4 | 5 | 3 | 5 | 4 | 3 | 4 | 6 | 3 |
| Chroma | 1 | 2 | 6 | 2 | 2 | 3 | 2 | 2 | 2 | 3 |

A: Composition of marking layer (Mass %)

4. The spark plug as set forth in claim 3, wherein the glaze layer comprises 1 to 25 mol % of the Zn component in terms of Zn0.

5. The spark plug as set forth in claim 1 or 2, wherein the marking layer further comprises at least one of Fe, Cr, Co and Mn as metal component(s).

6. The spark plug as set forth in claim 5, wherein the marking layer comprises at least one of Fe and Mn, and at least one of Cr and Co as metal components.

7. The spark plug as set forth in claim 6, wherein the marking layer comprises Fe and Cr as metal components.

8. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 3 or less in brightness as specified by 1993 JIS: Z8721 as well as 3 or less in the chroma as specified by 1993 JIS: Z8721;

wherein the marking layer comprises 30 to 60 mass % of a Fe component in terms of $Fe_2O_3$, and 10 to 40 mass % of a Cr component in terms of $Cr_2O_3$.

9. The spark plug as set forth in claim 8, wherein the marking layer comprises 10 to 25 mass % of the Cr component in terms of $Cr_2O_3$.

10. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 3 or less in brightness as specified by 1993 JIS: Z8721 as well as 3 or less in the chroma as specified by 1993 JIS: Z8721, wherein the marking layer comprises 10 to 40 mass % of a Co component in terms of CoO.

11. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 3 or less in brightness as specified by 1993 JIS: Z8721 as well as 3 or less in the chroma as specified by 1993 JIS: Z8721;

wherein the marking layer further comprises at least one of Fe, Cr, Co and Mn as metal components, and 0.5 to 15 mass % of a Ni component in terms of $Ni_2O_3$.

12. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 3 or less in brightness as specified by 1993 JIS: Z8721 as well as 3 or less in chroma as specified by 1993 JIS: Z8721;

wherein the marking layer further comprises at least one of Fe, Cr, Co and Mn as metal components, and 0.5 to 15 mass % in total of at least one of an Al component and a Ba component, the Al component being in terms of $Al_2O_3$ and the Ba component being in terms of BaO.

13. A spark plug having:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO and 1 to 25 mol % of a Zn component in terms of ZnO, and the marking layer comprises 30 to 60 mass % of an Fe component in terms of $Fe_2O_3$, and 10 to 40 mass % of a Cr component in terms of $Cr_2O_3$.

14. The spark plug as set forth in claim 13, wherein the marking layer comprises 10 to 25 mass % of the Cr component in terms of $Cr_2O_3$.

15. The spark plug as set forth in claim 13, wherein the marking layer comprises 10 to 40 mass % of a Co component in terms of CoO.

16. The spark plug as set forth in claim 13, wherein the marking layer further comprises 0.5 to 15 mass % of a Ni component in terms of $Ni_2O_3$.

17. The spark plug as set forth in claim 13, wherein the marking layer comprises 0.5 to 15 mass % in total of at least one of an Al component and a Ba component, the Al component being in terms of $Al_2O_3$ and the Ba component being in terms of BaO.

18. A spark plug comprising:

an insulator;

a marking layer is between 1 and 10 $\mu$m and formed on a surface of the insulator; and a glaze layer covering the marking layer so that the marking layer can be seen through the glaze layer, wherein the glaze layer is between 10 and 50 $\mu$m and comprises 5 mol % or less of a Pb component in terms of PbO, and the tint of the marking layer seen through the glaze layer is 3 or less in brightness as specified by 1993 JIS: Z8721 as well as 3 or less in chroma as specified by 1993 JIS: Z8721, and wherein the marking layer comprises at least one of Fe and Mn, and at least one of Cr and Co as metal components.

19. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 4 or less in brightness as specified by 1993 JIS: Z8721 as well as 2 or less in chroma as specified by 1993 JIS: Z8721;

wherein the marking layer comprises 30 to 60 mass % of a Fe component in terms of $Fe_2O_3$, and 10 to 40 mass % of a Cr component in terms of $Cr_2O_3$.

20. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 4 or less in brightness as specified by 1993 JIS: Z8721 as well as 2 or less in chroma as specified by 1993 JIS: Z8721;

wherein the marking layer comprises 10 to 40 mass % of a Co component in terms of CoO.

21. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 4 or less in brightness as specified by 1993 JIS: Z8721 as well as 2 or less in chroma as specified by 1993 JIS: Z8721;

wherein the marking layer further comprises at least one of Fe, Cr, Co and Mn as metal components, and 0.5 to 15 mass % of a Ni component in terms of $Ni_2O_3$.

22. A spark plug comprising:

an insulator;

a marking layer formed on a surface of the insulator; and a glaze layer covering the marking layer so that the marking layer can be seen through the glaze layer, wherein the glaze layer comprises 5 mol % or less of a Pb component in terms of PbO, and the tint of the marking layer seen through the glaze layer is 4 or less in brightness as specified by 1993 JIS: Z8721 as well as 2 or less in chroma as specified by 1993 JIS: Z8721;

wherein the marking layer further comprises at least one of Fe, Cr, Co and Mn as metal components, and 0.5 to 15 mass % in total of at least one of an Al component and a Ba component, the Al component being in terms of $Al_2O_3$ and the Ba component being in terms of BaO.

23. A spark plug comprising:

an insulator;

a marking layer is between 1 and 10 $\mu$m formed on a surface of the insulator; and a glaze layer covering the marking layer so that the marking layer can be seen through the glaze layer, wherein the glaze layer is between 10 and 50 $\mu$m and comprises 5 mol % or less of a Pb component in terms of PbO, and the tint of the marking layer seen through the glaze layer is 4 or less in brightness as specified by 1993 JIS: Z8721 as well as 2 or less in chroma as specified by 1993 JIS: Z8721, and wherein the marking layer comprises at least one of Fe and Mn, and at least one of Cr and Co as metal components.

* * * * *